US007520963B2

(12) United States Patent
Honkanen et al.

(10) Patent No.: US 7,520,963 B2
(45) Date of Patent: Apr. 21, 2009

(54) EQUIPMENT FOR MOVING THE ROLL OF A PAPER MACHINE

(75) Inventors: Tapani Honkanen, Kerava (FI); Tuomo Juvakka, Jyskä (FI); Timo Kukko, Simpsonville, SC (US)

(73) Assignee: Metso Paper, Inc., Helsinki (FI)

( * ) Notice: Subject to any disclaimer, the term of this patent is extended or adjusted under 35 U.S.C. 154(b) by 398 days.

(21) Appl. No.: 10/596,481

(22) PCT Filed: Dec. 15, 2004

(86) PCT No.: PCT/FI2004/050187

§ 371 (c)(1),
(2), (4) Date: Jun. 14, 2006

(87) PCT Pub. No.: WO2005/059244

PCT Pub. Date: Jun. 30, 2005

(65) Prior Publication Data

US 2007/0101817 A1 May 10, 2007

(30) Foreign Application Priority Data

Dec. 18, 2003 (FI) ..... 20035242

(51) Int. Cl.
*D21F 1/18* (2006.01)
*B06B 1/16* (2006.01)
*D21F 1/20* (2006.01)

(52) U.S. Cl. ..... 162/355; 162/256; 162/257; 74/61

(58) Field of Classification Search ..... 162/199, 162/209, 216, 256, 257, 262, 272, 341, 342, 162/355, 356, 365; 74/61, 87
See application file for complete search history.

(56) References Cited

U.S. PATENT DOCUMENTS 3,208,292 A * 9/1965 Austin et al. ..... 74/61

(Continued)

FOREIGN PATENT DOCUMENTS

DE 9317640 U1 3/1994

(Continued)

OTHER PUBLICATIONS

Search Report issued in PCT/FI2004/050187.

(Continued)

*Primary Examiner*—Eric Hug
(74) *Attorney, Agent, or Firm*—Stiennon & Stiennon

(57) ABSTRACT

Equipment for moving a roll in a paper machine has a movable cradle (13) for attachment to a roll (10). Two pairs of masses (16, 17) are supported rotatably on the cradle (13), in each of which there is an own drive shaft (18) for rotating the pairs of masses (16, 17). Drive devices (19) include a motor (21) and drive-train means (22). The drive-train means (22) include a pair of gears (23), which are arranged in connection with the drive shafts (18), for rotating the drive shafts (18) using a single motor (21). The drive-train means (22) also includes an adjustment element (33) for creating and adjusting the phase difference of the drive shafts (18). The adjustment element (33) is arranged between a gear (25) and the corresponding drive shaft (18), to change their position and thus to create and adjust a phase difference between the drive shafts (18).

18 Claims, 6 Drawing Sheets

U.S. PATENT DOCUMENTS 4,481,835 A 11/1984 Storm
5,825,663 A * 10/1998 Barba et al. ..... 702/41

FOREIGN PATENT DOCUMENTS

FI 20035242 12/2003
GB 836957 6/1960
WO 91/08842 A2 6/1991
WO WO 98/35094 * 8/1998
WO 2005/059244 A1 6/2005

OTHER PUBLICATIONS

Written Opinion of the International Searching Authority in PCT/FI2004/050187.
Search Report issued in priority application FI 20035242.

* cited by examiner

EQUIPMENT FOR MOVING THE ROLL OF A PAPER MACHINE

CROSS REFERENCES TO RELATED APPLICATIONS

This application is a U.S. national stage application of international App. No. PCT/FI2004/050187, filed Dec. 15, 2004, the disclosure of which is incorporated by reference herein, and claims priority on Finnish App. No. 20035242, filed Dec. 18, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to equipment for moving the roll of a paper machine, which roll is arranged to be moved in an axial direction, and which equipment includes

- a cradle arranged to move, which is intended to be attached to the roll,
- two pairs of masses, which are supported rotatably on the cradle,
- a drive shaft in each of the pairs of masses, for rotating the pairs of masses,
- drive devices for rotating the drive shafts in the desired phase, which drive devices include a motor and drive-train means fitted to the drive shafts,
- the drive-train means include a pair of intermeshed gears, which are arranged in connection with the drive shafts, in order to rotate the drive shafts using a single motor, and
- the drive-train means include an adjustment element for creating and adjusting the phase difference of the drive shafts.

The equipment described in the introduction is used in a paper machine, particularly for oscillating a so-called breast roll. In other words, the breast roll, which is arranged to support the wire, is moved in its axial direction. In a four-drinier-wire machine, the fibre suspension is fed onto the wire precisely at the breast roll, so that moving the breast roll makes the wire too move in the cross-direction of the paper machine. The fibre suspension will then spread evenly over the wire.

On account of the magnitude of the mass being moved and the frequency used, simple operating devices, such as hydraulic cylinders, are unsuitable for this purpose. In addition, the use of hydraulic cylinders would induce large forces in the foundations of the paper machine. Thus, in modern equipment, the so-called center-of-gravity principle is used, which is implemented with the aid of two pairs of masses arranged to rotate. Each pair of masses is formed of two eccentric masses, which are mutually synchronized. The axes of rotation of the pairs of masses are at right-angles to the axis of rotation of the breast roll and the pairs of masses are mounted in bearings in a special cradle. The working motion of the equipment is created by arranging a suitable phase difference in the rotating pairs of masses. In addition, the length of the working motion can be adjusted by altering the said phase difference. When they are in completely opposing phases, the pairs of mass cancel out each other's effect, so that the cradle remains stationary.

One known apparatus is disclosed, for example, in WO publication 98/35094. In the apparatus, the pairs of masses are rotated by two electric motors, which are regulated separately to create the desired phase difference. This allows the length of the working motion to be adjusted. In practice, two frequency converters are required to make the adjustment, as well as effective control software together with peripheral devices.

In addition, in order to ensure sufficient regulation tolerance, high-power special electric motors are required. Thus, the equipment becomes complicated and expensive, especially in the case of the automation and the electric motors. In addition, the pairs of masses are generally used in a super-critical frequency range, during the change to which the stroke of the equipment is momentarily multiplied. In practice, the pairs of masses are first accelerated in opposite phases to the operation velocity, after which, by adjusting the phase difference the stroke is lengthened from zero to a desired value. If the electric motors, or their controls fail, or if there is a sudden total power outage, the rotational velocities of the pairs of masses decrease uncontrollably. When returning to the critical speed range, the stroke of the apparatus will then peak suddenly, breaking the equipment and possibly even the structures of the paper machine.

GB Pat. No. 836957 discloses a device, by which it might perhaps be possible to create sufficient oscillation to move a breast roll. The device is, in fact, proposed for moving, for example, a sieve. In addition, the structure of the rotating masses, and particularly their operating principle clearly differ from that described above. In the patent in question, the corresponding masses of the adjacent pairs of masses are mutually synchronized and only the mutual position of the masses of each pair of masses is altered using a complicated gear train. In other words, instead of altering the phase difference of the pairs of masses, what is altered is the mutual position of the masses, relative to the axis of rotation of the pair of masses. In addition, on top of the so-called center shaft there is a hollow shaft, to which the gear train is fitted. By rotating the relevant train relative to the center shaft, the mutual positions of the masses can be altered, without, however, altering the mutual phase difference of the pairs of masses. The synchronization ensures that the masses always rotate in the same phase. The device disclosed is complicated and the forces it creates are too small to move a breast roll. In addition, the drive train of the device cannot be adapted to the pairs of masses presently in use. In terms of control, the gear train is also slow and also unsuitable in practice, due, among other things, to the irreversible control.

SUMMARY OF THE INVENTION

The invention is intended to create an entirely new type of equipment for moving a roll in a paper machine, which is simpler, more reliable, and cheaper than previously and by means of which the drawbacks of the prior art can be avoided. In the equipment according to the invention, particularly the drive train and its control are implemented in a new and surprising manner. The pairs of masses can be rotated using a single motor, by using a special drive train, which permits the mainly mechanical implementation of the phase-difference adjustment. The simple and small drive train can even be combined with existing equipment, without having to alter the pairs of masses or the cradle. Further, in the equipment, the control of the motor and of the drive train can be implemented separately. Thus, for example, the stroke achieved by the equipment can be adjusted independently of the motor. In addition, though the devices required for the control are simple, the adjustment is nevertheless precise. The total cost of the equipment according to the invention is considerably lower than that of the prior art. In addition to this, control of the equipment is ensured even in fault situations, thus eliminating, or at least substantially reducing the danger of breakage. The equipment is also smaller in size and easier to install than before.

In the following, the invention is examined in detail with reference to the accompanying drawings showing some applications of the invention.

DESCRIPTION OF THE PREFERRED EMBODIMENTS

Figure 1:
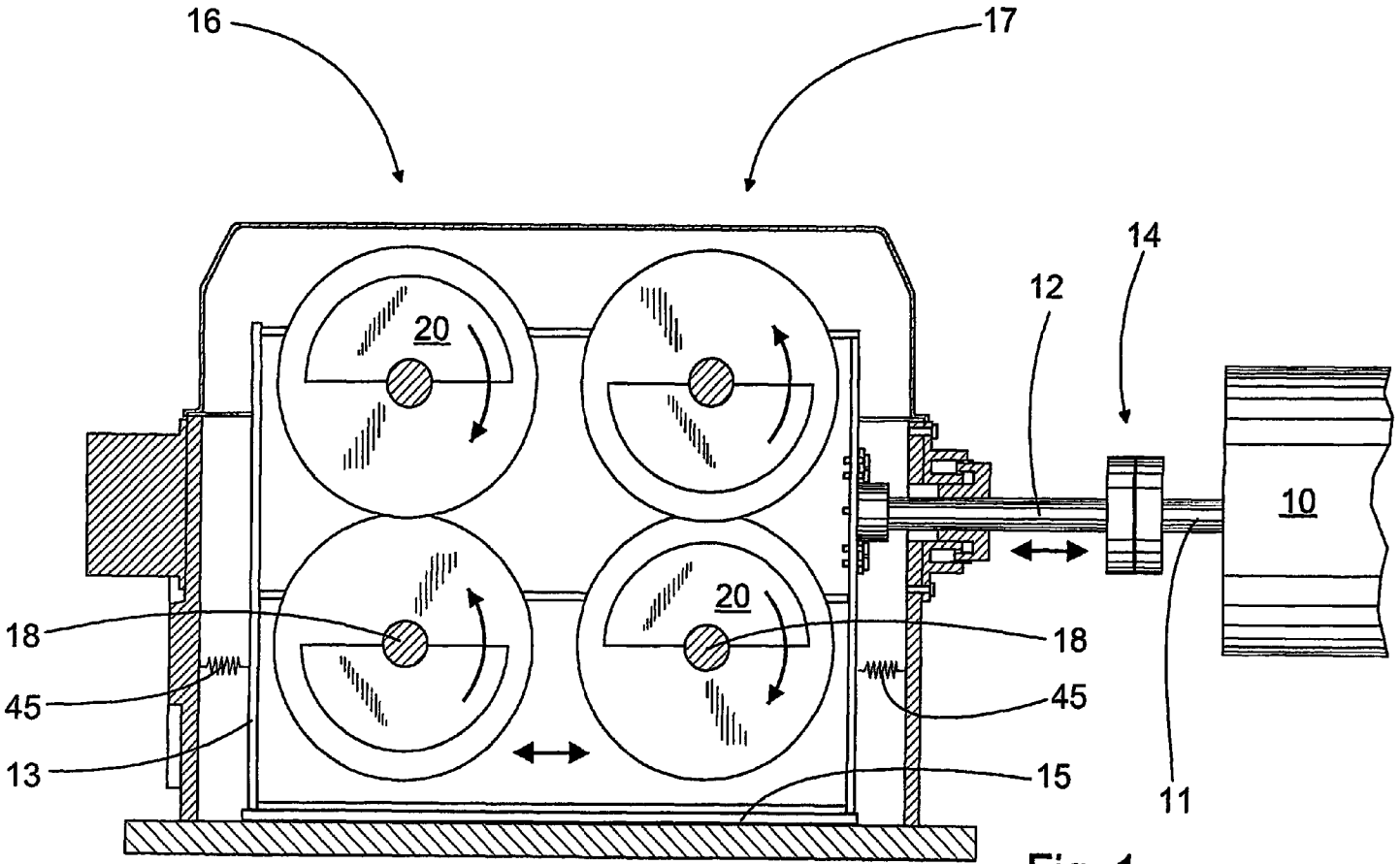
FIG. 1 is a schematic diagram of a cross-section of the equipment according to the invention.

FIG. 1 shows a cross-section of the breast roll 10 of a paper machine and the equipment according to the invention attached to it. The breast roll, more simply the roll 10 is mounted at both ends in bearings, which permit the roll 10 to move axially. The axial movement usually used is about 10-30 mm. In addition, the roll 10 is connected, by a operating rod 12, to a cradle 13 forming part of the equipment. In the operating rod 12, there is additionally a thrust bearing 14, to permit the rotation of the roll 10. In other words, the operating rod 12 remains stationary, while the shaft 11 rotates. Correspondingly, the cradle 13 intended to be connected to the roll 10 is mounted in sliding bearings in the frame of the equipment. Usually, hydrostatic sliding bearings 15 are used. In other words, the cradle slides on top of a lubricant membrane. The parts of the equipment that move along with the roll 10 are thus not only the operating rod 12, but also the cradle 13 with its pairs of masses 16 and 17. On the basis of the length and frequency of the movement of the roll, the equipment is also called a jogger or a shaker.

Figure 2:
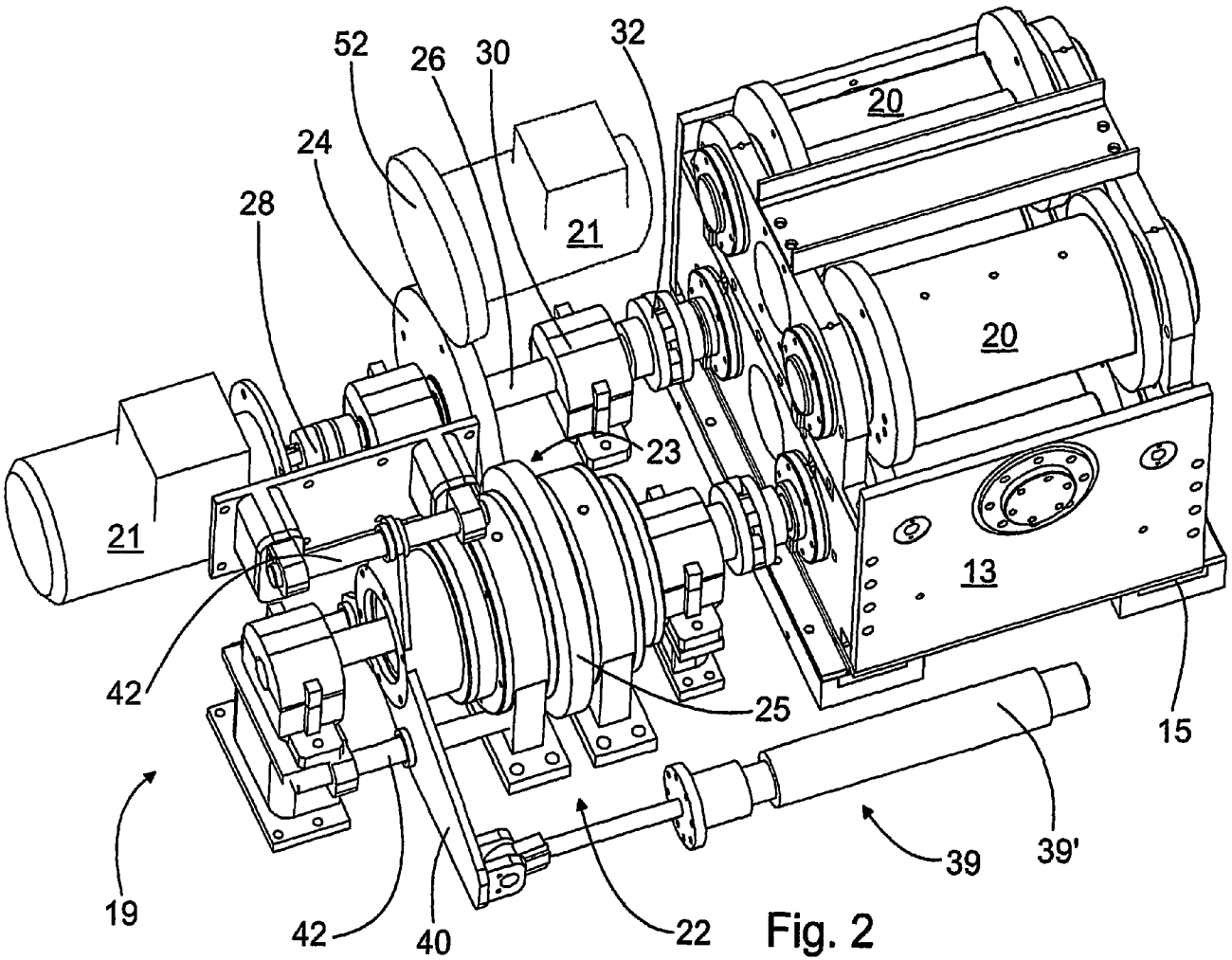
FIG. 2 is an axonometric view of the drive train of the equipment according to the invention.

In the equipment, there are thus two pairs of masses 16 and 17, which are supported rotatably in the cradle 13. In addition, each pair of masses 16 and 17 has its own drive shaft 18 for rotating the masses 20 (FIG. 1). Further, the equipment includes a drive device 19 for rotating the drive shafts 18 in the desired phase and thus for adjusting the phase difference between the pairs of masses 16 and 17 (FIG. 2). The phase difference between the drive shafts and thus between the pairs of masses is used to regulate the movement of the cradle and thus the length of the stroke achieved. In practice, each pair of masses is formed of two eccentric masses, each of which mainly recalls a half cylinder. In addition, the masses belonging to the pairs of masses are synchronized with each other, for example, using a gear train, so that the shaft of one mass is also the drive shaft of the pair of masses. In other words, the masses in the pairs of masses rotate always in the same way relative to each other. In FIG. 1, the pairs of masses 16 and 17 are in the same phase, so that the stroke of the cradle 13 is at its maximum. The two-headed arrows, however, illustrate the back-and-forwards movement of the cradle in FIG. 1.

The back-and-forwards movement created by the combined effect of the pairs of masses is thus based on their mutual phase difference. The pairs of masses in opposite phases cancel out each other's effect, in which case the stroke will be zero. By altering the phase difference, the center of gravity of the system formed by the pairs of masses and the cradle begins to move backwards and forwards horizontally. According to the invention, the drive device 19 surprisingly includes only one motor 21 and drive-train means 22 fitted to the drive shafts 18, in order to create and adjust the said phase difference. The control of the single motor, which is preferably an electric motor, is considerably easier and simpler than that of the special electric motor according to the prior art. In addition, the drive-train means are used only to adjust the phase difference, from which the control of the electric motor is independent. Thus the control of the equipment is simple and precise, without complex control devices.

Figure 3:
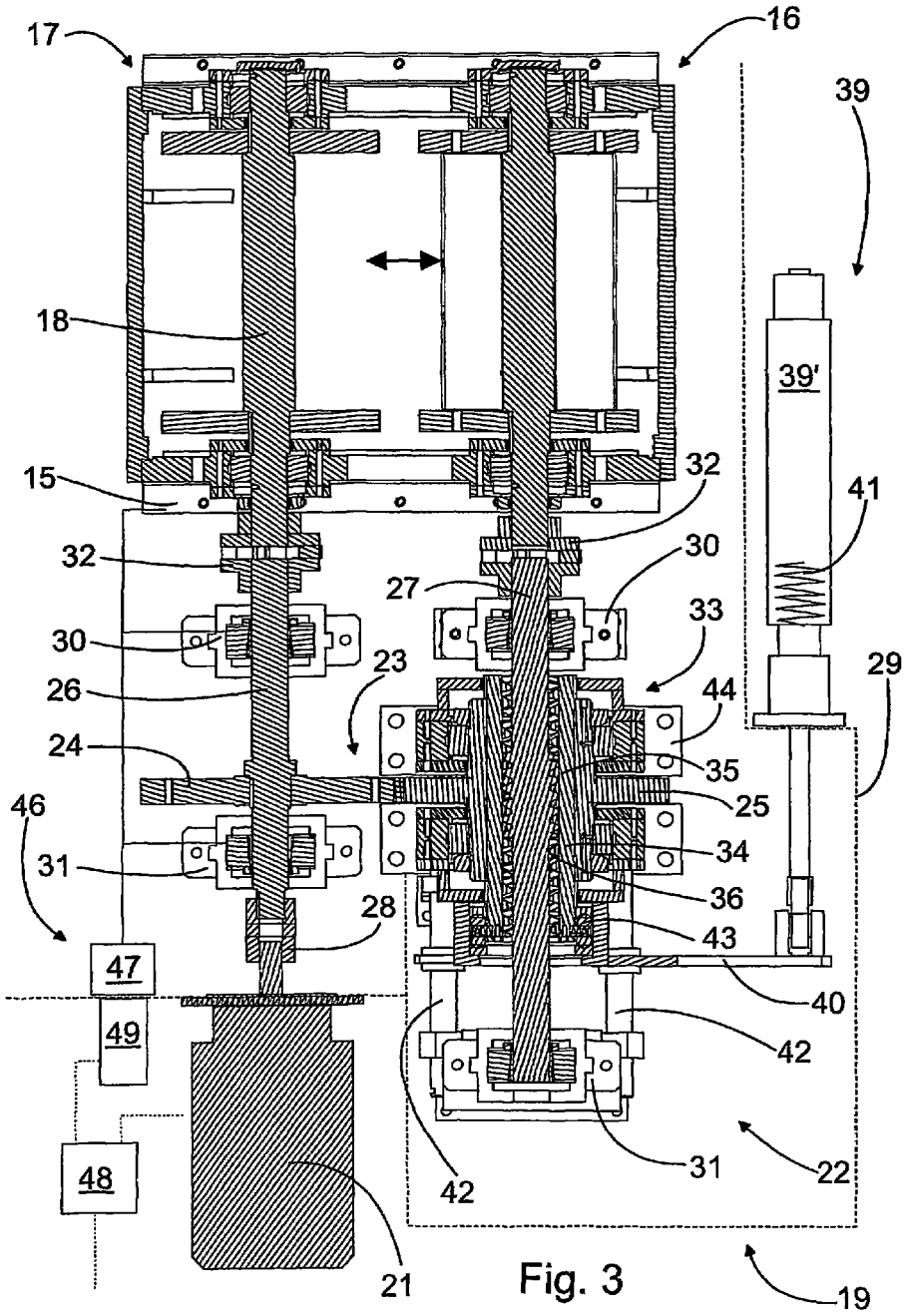
FIG. 3 is a cross-sectional view of the drive train of FIG. 2.

FIG. 3 shows the drive-train means 22 according to the invention in greater detail, which in this case consists of a pair of intermeshed gears 23. In FIG. 2, the gears 24 and 25 in question are encased, to reduce the splashing of lubricant. In practice, the pair 23 of gears is arranged in connection with the auxiliary shafts 26 and 27 arranged as a continuation of both drive shafts 18, in order to rotate both drive shafts 18 by a single motor. It is then possible to use a conventional motor, which can be dimensioned according to the required moment, without an additional control moment. In addition, the pairs of gears cause the drive shafts to rotate in opposite directions, which is essential in terms of the operating principle of the equipment. The outer diameter and number of teeth of the gears are the same, so that the transmission ratio of the pair of gears is 1:1. The motor is preferably an electric motor, which is connected directly as a continuation of one auxiliary shaft. As the gear 24 is fitted to the auxiliary shaft 26, the conventional shaft connection 28 can be used to attach the electric motor. In the equipment according to the invention, the pairs of masses 16 and 17 and the drive-train means 22 are arranged in a casing 29, inside which lubricant circulates. In this case, the electric motor 21 is secured to the casing 29 by a flange joint, which is partly shown in FIG. 3 by a broken line.

In practice, each mass is fitted to a shaft, at the ends of which they are mounted in bearings in the cradle. In addition, each auxiliary shaft 26 and 27 is also mounted in two bearings 30 and 31. Between the auxiliary shafts 26 and 27, and the drive shaft 18, there are, in addition, special clutches 32, which permit radial movement between them, despite the rotational movement. In practice, the auxiliary shafts 26 and 27 thus remain stationary, while the drive shafts 18 of the masses 20 move with the cradle 13. The same reference numbers are used for components that are functionally similar. In FIG. 3, the auxiliary shaft 26 connected to the electric motor 21 includes only the aforementioned bearings 30 and 31 along with the special clutch 32 and the gear 24. Correspondingly, the other auxiliary shaft 27 has an adjustment element 33 forming part of the drive-train means 22, which is arranged between the gear 25 and the auxiliary shaft 27. The adjustment element can be used to alter the mutual positions of the gear 25 and the auxiliary shaft 27 and thus ultimately adjust the phase difference between the drive shafts. In practice, it is precisely the position of the gear and the auxiliary shaft relative to the common axis of rotation that is altered.

Figure 4A:
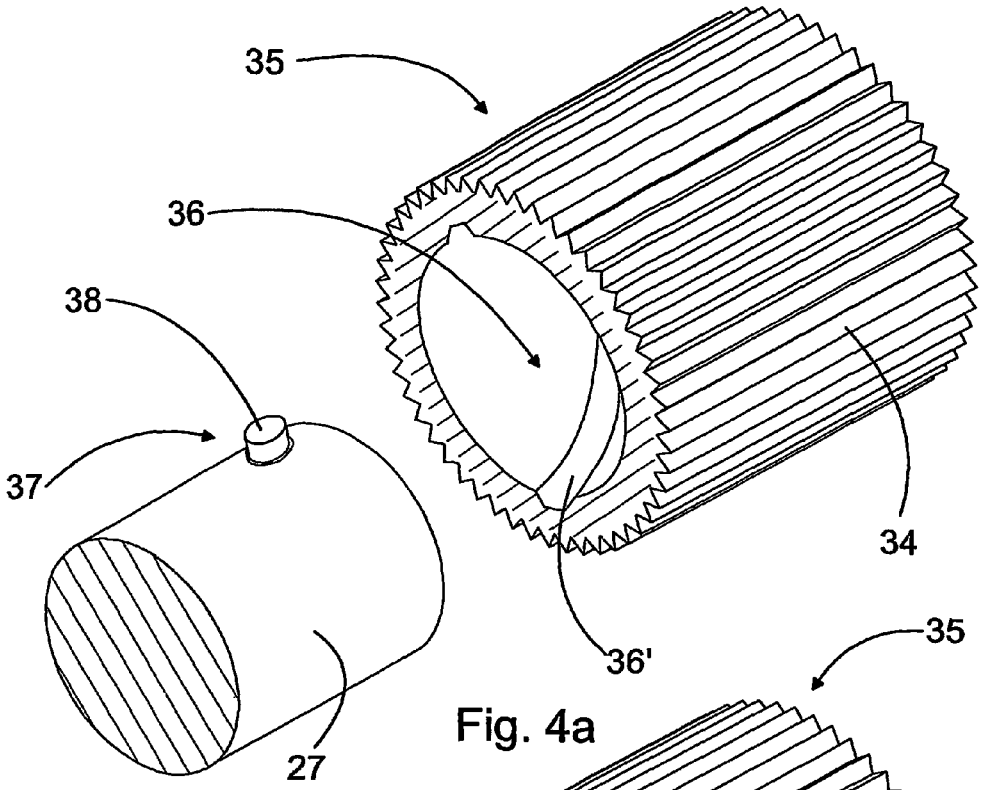
FIG. 4*a* shows a cross-section of the auxiliary shaft according to the invention and its corresponding control element.

In the embodiment of FIG. 3, the adjustment element 33 is a sleeve 34, which is arranged to be moved axially relative to both the auxiliary shaft 27 and the gear 25. In addition, in order to transmit a moment from the gear through the sleeve to the auxiliary shaft, there is a shape-locking construction on both the inner and outer surfaces of the sleeve. In this case, the outer surface of the sleeve 34 has straight grooving 35, with corresponding straight grooving arranged in the gear (FIG. 4*a*). The grooving is arranged in such a way that the sleeve can be moved relative to the gear. Due to the straight, i.e. axial direction of the grooving, the mutual position of the sleeve and the gear remain unchanged, independently of the location of the sleeve. However, the inner surface of the sleeve 34 has spiral grooving 36, with a corresponding protrusion 37 arranged in the auxiliary shaft 27 to fit the single spiral groove 36'. Also the spiral grooving is arranged in such a way that the sleeve can be moved relative to the auxiliary shaft. The spiral grooving means that when the sleeve is moved axially, the auxiliary shaft rotates relative to the gear, thus changing their mutual position. This creates a phase difference between the auxiliary shafts, which directly affects the stroke of the equipment. The use of the drive-train according to the invention thus creates a simple, but precise mechanical adjustment.

The sleeve 34 shown in FIG. 4*a* has two opposing spiral grooves 36', with corresponding protrusions 37 arranged as pin-like key 38 fitted to the auxiliary shaft 27. This avoids complicated machining in the auxiliary shaft, while the pin-like key can be manufactured from wear-resistant material. For example, the pin-like key can be installed in a hole arranged in the auxiliary shaft. Instead of a pin-like key, it is possible to use a longer longitudinal key, or a sliding piece (not shown) welded to the auxiliary shaft. In practice, the phase-difference adjustment required is about 90, which will keep the rise of the spiral groove reasonable. On the other hand, the adjustment tolerance can be easily altered simply by replacing the sleeve in the power-transmission with one with a different rise in its spiral groove. The other parts of the drive train will remain unchanged.

Figure 4B:
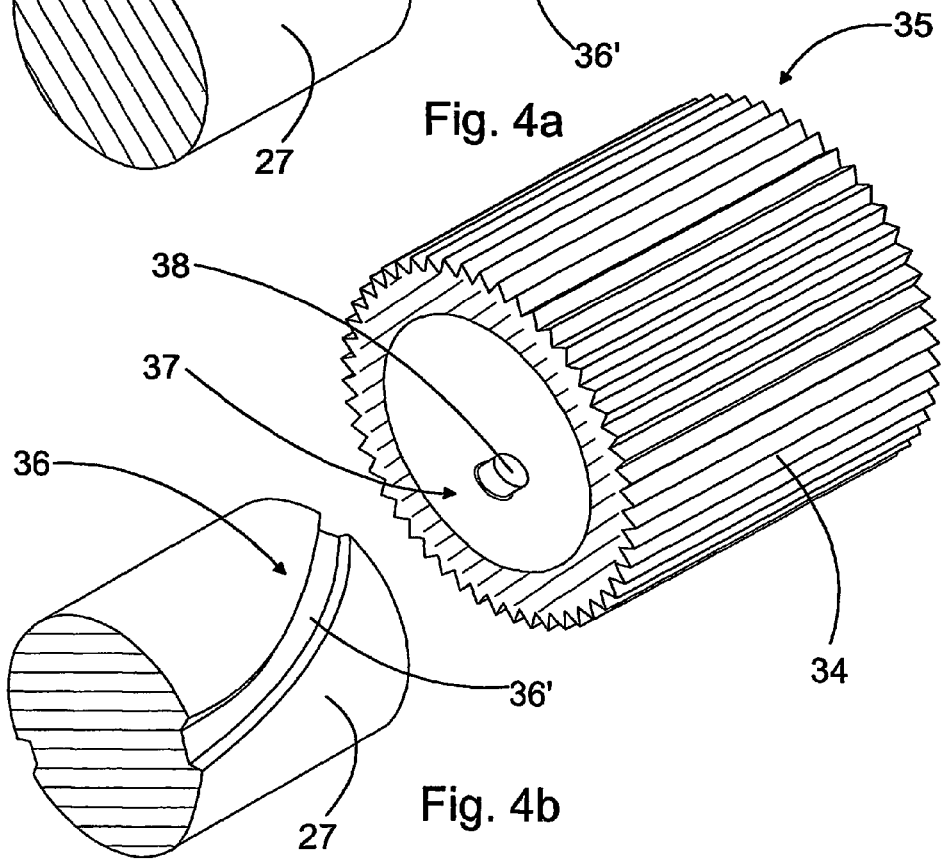
FIG. 4*b* shows a cross-section of a variation of the auxiliary shaft according to the invention and its corresponding adjustment element.

Generally, each shape-locking construction incorporates two counter-surfaces. In addition, the first counter-surface of one shape-locking construction has spiral grooving while the corresponding second counter-surface has a protrusion arranged to suit the spiral grooving. The embodiment of FIG. 4*b*, however, has the spiral grooving 36 on the surface of the auxiliary shaft 27. In the first embodiment, the protrusion 37 is on the auxiliary shaft 27, but in the second embodiment it is on the inner surface of the sleeve 34. However, the spiral grooving can be either on the outer surface of the sleeve, or on the inner surface of the gear. The protrusions corresponding to the spiral grooving will thus be already on the inner surface of the gear, or on the outer surface of the sleeve (not shown).

The desired phase difference is thus created simply by moving the adjustment element. To operate the adjustment element 33, the drive-train means 22 includes a drive device 39, which is preferably arranged to be self-returning. In practice, the drive device is arranged in such a way that, in a fault situation, the drive device returns to the initial position, where the effect of the adjustment element is zero. The phase difference between the auxiliary shafts is then automatically removed and the back-and-forwards movement of the equipment stops, preventing damage from arising. In FIGS. 2 and 3, the drive device 39 is a hydraulic cylinder 39', which drives the sleeve 34 through a linkage 40. The hydraulic cylinder 39' also has a return spring 41, which moves the linkage 40 to the initial position, if the hydraulic pressure fails. The return spring can also be arranged in connection with the linkage. Alternatively, the drive device can be arranged to be lockable, so that the adjustment is in any event controllable. A screw mechanism with a hydraulic or step-motor drive, for example, can be used instead of the hydraulic cylinder. In general, nearly any drive device at all, which can create an axial movement, can be used. For example, a pneumatic cylinder can be used instead of a hydraulic cylinder. The triangular linkage 40 is supported in this case by three axial guides 42. In addition, there is a thrust bearing 43 between the linkage 40 and the sleeve 34, which permits the sleeve 34 to rotate, while the linkage 40 moves only axially. In this case, the gear 25 also includes special radial bearings 44.

The figures do not show the devices, which the drive-train means according to the invention allow to be simple, used to control the electric motor and the drive element. In practice, the electric motor is controlled using a frequency converter and the drive element by conventional regulators. In addition, the movement of the drive element is directly proportional to the phase difference to be achieved in the pairs of masses, which facilitates the adjustment and control of the equipment. The adjustment of the phase difference is also stepless. In addition to the pairs of masses 16 and 17, there are also springs 45 in the cradle 13, so that the equipment forms a functional oscillator (FIG. 1). The operating range of the frequency of the oscillator is about 10 Hz, with the critical point located at about 2 Hz. In other words, the equipment is used in the super-critical frequency range. In the example application, the nominal output of the equipment's electric motor is 7.5 kW, though the measured power required to rotate the masses is only about 4 kW. Thus the motor output required is considerably lower than in known equipment, which uses two 34-kW special electric motors. As the motor power increases, the frequency converters also increase significantly in size.

When the equipment is started, the pairs of masses are first accelerated over the critical point to the operating range, after which the phase difference is adjusted to set the length of the stroke as desired.

The above description of the operation of the equipment has also included a situation, in which the control of the drive train has become defective for some reason. In practice, there may have been a total electricity outage, when the phase difference preferably drops to zero. The springs, however, cause the oscillation to continue for some time. The hydrostatic sliding bearings of the cradle are connected to the circulating lubrication system 46 belonging to the equipment and including a feed pump 47. The circulating lubrication system 46 feeds lubricant along channels, not only to the sliding bearings 15, but also, for example, to other bearings 31 and 32, as well as to the meshes of the pair of gears 23. In a power outage, the electric motor 49 of the feed pump 47 will stop, so that lubrication will cease. The lubricant layer will rapidly disappear particularly from the sliding bearings, causing the bearing surfaces of the sliding bearings to come into mechanical contact. As the equipment oscillates, the bearing surfaces will generally be worn to become useless.

According to the invention, the control system 48 connected to the circulating lubrication system 46 sets the electric motor 21 to operate as a generator, the current obtained from which being led to the electric motor 49 of the feed pump 47. Thus, despite the power outage, the circulating lubrication will operate until the pairs of masses stop. At its simplest, the control system has suitable relays, which connect the terminals of the squirrel-cage motor to the electric motor of the feed pump. FIG. 3 shows schematically the feed pump 47 together with its electric motor 49, which usually has a nominal output of about 2.2 kW. The inertia of the masses will ensure the operation of the circulating lubrication for long enough to avoid bearing damage.

Figure 5:
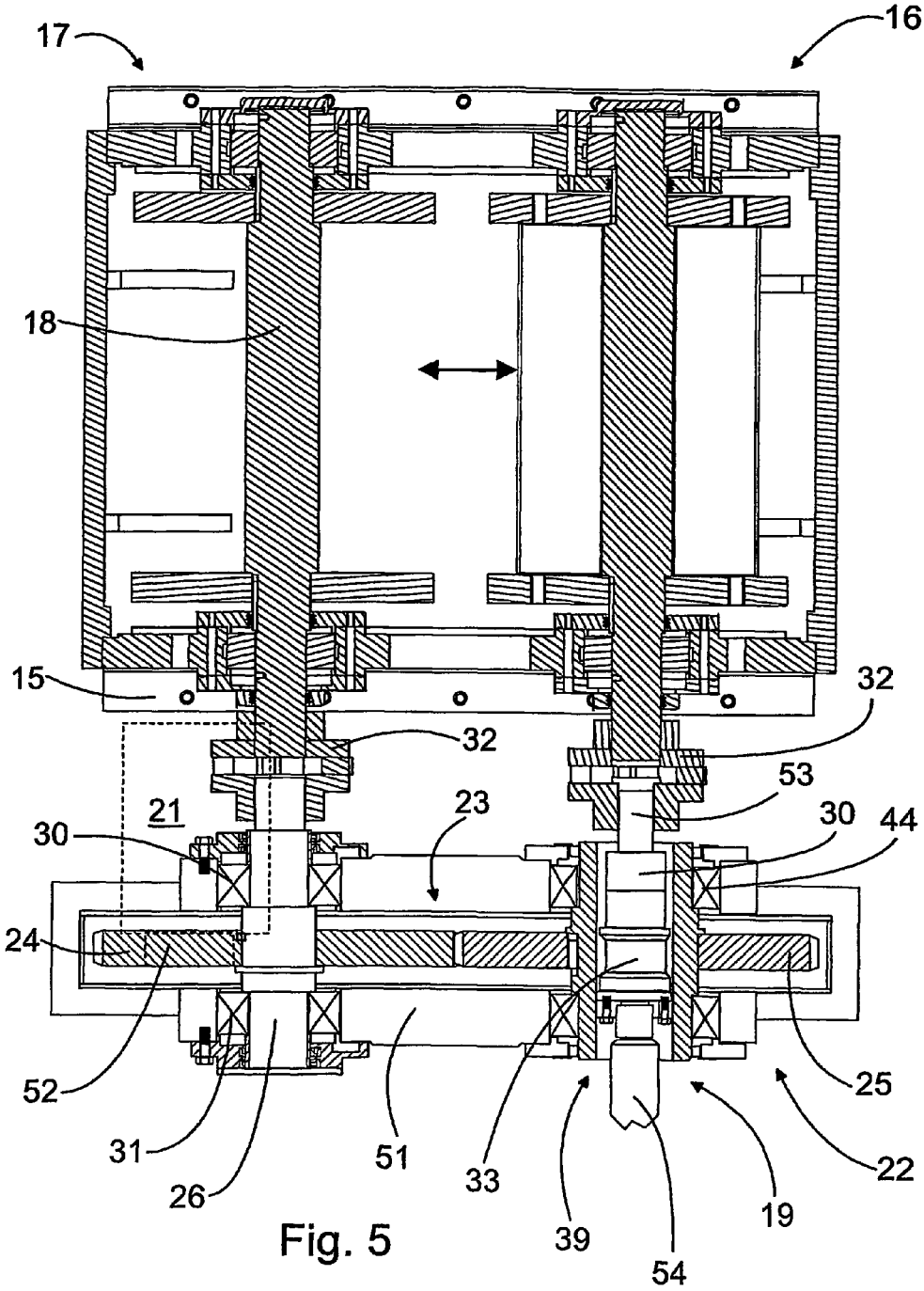
FIG. 5 shows a cross-section of a second embodiment of the drive train of the equipment according to the invention.

FIG. 5 shows a cross-section of a second embodiment of the equipment according to the invention. The cradle 13 with its pairs of masses 16 and 17 corresponds to that depicted above, the same reference numbers being used for components that are functionally similar. Particularly the drive train differs from that referred to above. First of all, the pair of gears 23 and the auxiliary shafts 26 and 27 are supported on a common and essentially rigid bearing stand 51. This allows the drive train to be installed separately, which is a significant advantage when installing equipment weighing several thousands of kilos. In addition, the positions and alignments of the auxiliary shafts and especially of the gears relative to each other will remain unchanged, despite the movement of, or installation errors in the drive train. The solution also reduces the amount of installation space required. The motor 21 can be installed as a continuation of the auxiliary shaft 26, or alternatively above it, which will further reduce the size of the equipment. The broken lines in FIGS. 2 and 5 show the alternative installation position of the motor 21. By using an additional gear 52, power is transmitted from the motor 21 to the gear 24. At the same time, the gear ratio can also be altered by suitable dimensioning of the additional gear.

Figure 6A:
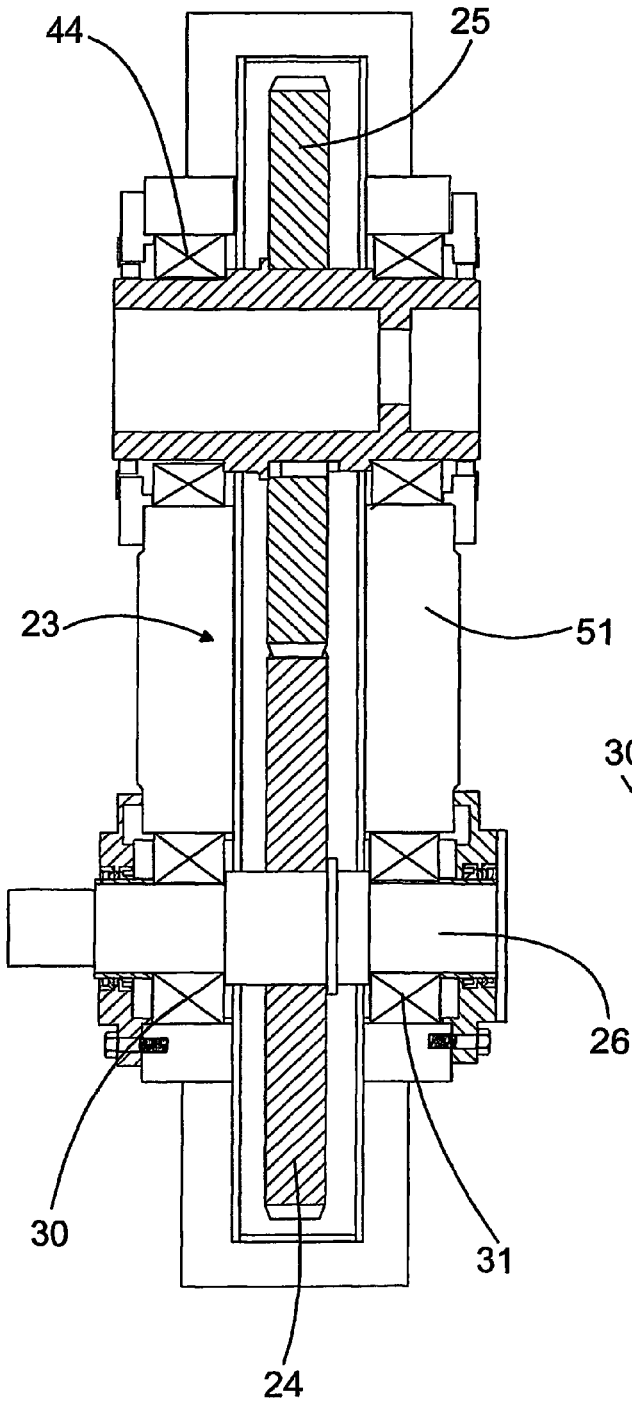
FIG. 6*a* shows the drive train of FIG. 5 separated from the equipment.

A second important change is that the adjustment element 33 is arranged as part of the drive device 39. In other words, the drive device includes an adjustment element, in order to create a phase difference. The use of the solution in question further simplifies the construction of the equipment and reduces the installation space required. The drive device can now be fitted inside the gear 25. According to the invention, the drive device 39 also includes bearings and a shaft 53, which is arranged as part of the drive shaft 18. This makes separate auxiliary shafts and their bearings unnecessary. In practice, the drive device 39 is attached to the gear 25 and the pressure-medium connection 54 that permits the associated rotational motion, for operating the drive device 39 while the gear 25 rotates. FIG. 6*a* shows the drive train without the operating device containing the adjustment element.

Figure 6B:
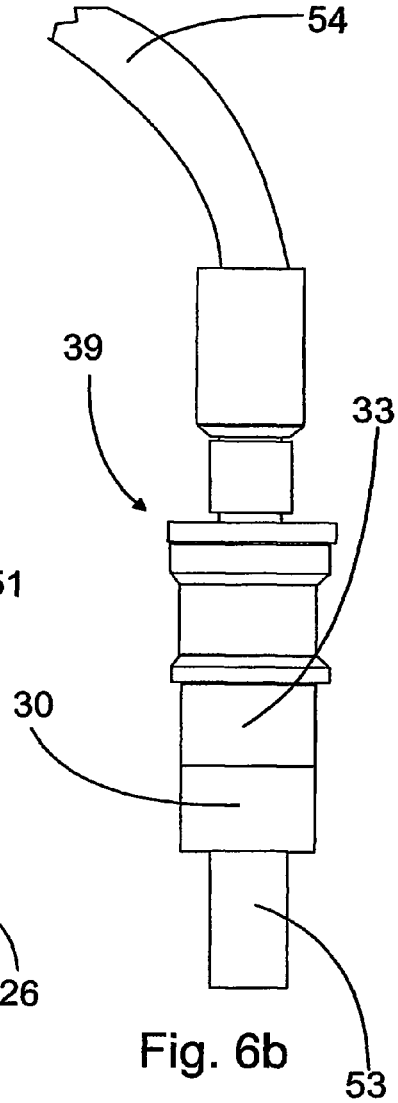
FIG. 6*b* shows separately the drive device forming part of the transmission of FIG. 5.

For example, a hydraulic rotator cylinder, which is also termed a rotator motor, can be applied as the drive device. The rotator cylinder is shown in FIG. 6*b*. In the rotator cylinder, the linear motion of the piston is converted, for example with the aid of nesting helical gears, into a rotational motion, thus achieving operation of the adjustment element according to the invention. By regulating the hydraulic pressure, the piston is moved, which rotates the shaft through the gears. In practice, the rotator cylinder thus rotates along with the gear. In the starting situation, the effect of the adjustment element is zero, in which case both drive shafts rotate in the same phase. When the phase difference is adjusted, the drive device is used to rotate the adjustment element, thus changing the position of the gear and the drive shaft relative to each other. Thus, the phase difference of the drive shafts and thus the pairs of masses also changes.

The equipment according to the invention is highly reliable in operation and is easy to adjust. In addition, simple components, for instance a normal squirrel-cage motor, can be used. The magnitude of the phase difference can be adjusted independently of the motor. In addition, in a fault situation, damage is avoided, thanks to the automatic return of the adjustment. At the same time, the circulating lubrication system continues to operate uninterruptedly. In addition, the equipment is smaller than previously and can be installed in parts.

The invention claimed is:

1. An apparatus for axially oscillating a roll of a paper machine, comprising:

a cradle mounted for linear motion and having a structure for attachment to the roll;

a first pair of eccentric masses rotatably mounted on the cradle, the first pair of eccentric masses being mutually synchronized and arranged to be driven in rotation by a first drive shaft;

a second pair of eccentric masses rotatably mounted on the cradle, the second pair of eccentric masses being mutually synchronized and arranged to be driven in rotation by a second drive shaft; and a drive train, wherein the drive train comprises a motor; a first gear arranged to be driven by the motor, the first gear connected to the first drive shaft;

a second gear mounted about the second drive shaft, the second gear directly intermeshed with the first gear; and an adjustment element, arranged between the second gear and the second drive shaft, and operable to rotate the second drive shaft relative to the first drive shaft in order to change their mutual position and thus to create and adjust a phase difference between the first drive shaft and the second drive shaft.

2. The apparatus of claim 1 further comprising:

a first auxiliary shaft, wherein the first gear is connected to the first drive shaft by the first auxiliary shaft; and a second auxiliary shaft forming a connection between the adjustment element and the second drive shaft.

3. The apparatus of claim 1, wherein the motor is an electric motor connected to the first drive shaft.

4. The apparatus of claim 2, wherein the first gear is arranged on the first auxiliary shaft, and the second gear is arranged on the second auxiliary shaft with the adjustment element arranged between the second gear and the second auxiliary drive shaft.

5. The apparatus of claim 1, wherein the drive train includes a drive device which is connected to operate the adjustment element to rotate the second drive shaft relative to the first drive shaft, and wherein the drive device is arranged to be self-returning to a initial position.

6. The apparatus of claim 3, further comprising a circulating lubrication system comprising:

a lubricant feed pump; and a control system, wherein the motor is arranged to act as a generator for rotating the lubricant feed pump in the case of a power outage.

7. The apparatus of claim 2, wherein the first gear, the second gear, the first auxiliary shaft, and the second auxiliary shaft are supported on a common and essentially rigid bearing stand.

8. An apparatus for axially oscillating a roll of a paper machine, comprising:

a cradle mounted for linear motion and having a structure for attachment to the roll;

a first pair of eccentric masses rotatablv mounted on the cradle, the first pair of eccentric masses being mutually synchronized and arranged to be driven in rotation by a first drive shaft;

a second pair of eccentric masses rotatably mounted on the cradle, the second pair of eccentric masses being mutually synchronized and arranged to be driven in rotation by a second drive shaft; and a drive train, wherein the drive train comprises a motor; a first gear arranged to be driven by the motor, the first gear connected to the first drive shaft;

a second gear interimeshed with the first gear; and an adjustment element, arranged between the second gear and the second drive shaft, and operable to rotate the second drive shaft relative to the first drive shaft in order to change their mutual position and thus to create and adjust a phase difference between the first drive shaft and the second drive shaft; and wherein the adjustment element is a sleeve mounted for axial movement relative to the second drive shaft and the second gear.

9. The apparatus of claim 8, wherein the sleeve transfers a moment from the second drive shaft to the second gear, and wherein the sleeve comprises:

an inner surface with a first shape-locking construction with respect to the second drive shaft; and an outer surface with a second shape-locking construction with respect to the second gear.

10. The apparatus of claim 9, wherein one of the first shape-locking construction or the second shape-locking construction comprises:

a first counter surface with spiral grooving; and a second counter surface with a protrusion arranged according to the spiral grooving of the first counter surface.

11. The apparatus of claim 9, wherein the outer surface of the adjustment element and the inner surface of the second gear have straight grooving.

12. The apparatus of claim 8, wherein the sleeve has an inner surface on which is formed a spiral grooving, in which spiral grooving a protrusion arranged on the second drive shaft travels.

13. The apparatus of claim 12, wherein there are two opposed spiral grooves on the inner surface of the sleeve, and two corresponding protrusions fitted to the second drive shaft or an auxiliary shaft connected to the second drive shaft.

14. An apparatus for axially oscillating a roll of a paper machine, comprising:

a cradle mounted for linear motion and having a structure for attachment to the roll;

a first pair of eccentric masses rotatably mounted on the cradle, the first pair of eccentric masses being mutually synchronized and arranged to be driven in rotation by a first drive shaft:

a second pair of eccentric masses rotatablv mounted on the cradle, the second pair of eccentric masses being mutually synchronized and arranged to be driven in rotation by a second drive shaft; and a drive train, wherein the drive train comprises a motor; a first gear arranged to be driven by the motor, the first gear connected to the first drive shaft; a second gear intermeshed with the first gear: and an adjustment element, arranged between the second gear and the second drive shaft, and operable to rotate the second drive shaft relative to the first drive shaft in order to change their mutual position and thus to create and adjust a phase difference between the first drive shaft and the second drive shaft;

wherein the drive train includes a drive device which is connected to operate the adjustment element to rotate the second drive shaft relative to the first drive shaft, and wherein the drive device is arranged to be self-returning to a initial position; and wherein the adjustment element and the drive device are fitted inside the second gear.

15. The apparatus of claim 14, wherein the drive device further comprises bearings and a shaft which is arranged as a continuation of the second drive shaft.

16. The apparatus of claim 14, wherein the drive device includes a pressure-medium connection permitting the rotational motion of the drive device while the second gear rotates.

17. An apparatus for axially oscillating a roll of a paper machine, the apparatus comprising:

a cradle mounted for linear motion and having a structure for attachment to the roll;

a first pair of eccentric masses rotatablv mounted on the cradle, the first pair of eccentric masses being mutually synchronized and arranged to be driven in rotation by a first drive shaft:

a second pair of eccentric masses rotatably mounted on the cradle, the second pair of eccentric masses being mutually synchronized and arranged to be driven in rotation by a second drive shaft; and a drive train comprising first and second intermeshing gears driven by a motor, wherein the first drive shaft is driven by said first intermeshing aear or said first intermeshing gear is driven by the first drive shaft, and wherein the second drive shaft is driven by said second intemeshing gear through an adjustment element, the adjustment element operable to rotate the second drive shaft relative to the first drive shaft in order to change their mutual position and thus to create and adjust a phase difference between the first drive shaft and the second drive shaft: and wherein the adjustment element is a sleeve structured to transmit moment from the second intermeshing gear to the second drive shaft, which sleeve is mounted for axial movement relative to the second drive shaft and the second intermeshing gear, and arranged so that the axial motion of the sleeve causes rotation of the second drive shaft with respect to the second intermeshing gear to create the phase difference between the first drive shaft and the second drive shaft.

18. An apparatus for axially oscillating a roll of a paper machine, the apparatus comprising:

a cradle mounted for linear motion and attachment to the roll to cause axial oscillation of the roll;

a first pair of eccentric masses rotatably mounted on the cradle, the first pair of eccentric masses being mutually synchronized and arranged to be driven in rotation by a first drive shaft;

a second pair of eccentric masses rotatably mounted on the cradle, the second pair of eccentric masses being mutually synchronized and arranged to be driven in rotation by a second drive shaft;

a motor;

wherein the first drive shaft and a first gear mounted to the first drive shaft are driven by the motor; and a second gear driven by the first gear, wherein the second drive shaft is driven by said second gear through an adjustment element, the adjustment element operable to rotate the second drive shaft relative to the first drive shaft in order to change their mutual position and thus to adjust a phase difference between the first drive shaft and the second drive shaft; and wherein the adjustment element is a sleeve structured to transmit moment from the second gear to the second shaft, which sleeve is mounted for axial movement relative to the second drive shaft and the second gear, and arranged so that the axial motion of the sleeve causes rotation of the second shaft with respect to the second gear, to create the phase difference between the first drive shaft and the second drive shaft.

* * * * *